US005980016A

United States Patent [19]

Nelson et al.

[11] Patent Number: 5,980,016

[45] Date of Patent: Nov. 9, 1999

[54] SYSTEMS AND METHOD FOR DETERMINING PRESENCE OF INKS THAT ARE INVISIBLE TO SENSING DEVICES

[75] Inventors: Gregory D. Nelson, Escondido; Otto K. Sievert, Encinitas; Robert D. Blanton, San Diego, all of Calif.

[73] Assignee: Hewlett-Packard Company, Palo Alto, Calif.

[21] Appl. No.: 08/636,439

[22] Filed: Apr. 22, 1996

[51] Int. Cl.[6] ..... B41J 29/393; B41J 2/21

[52] U.S. Cl. ..... 347/19; 347/43

[58] Field of Search ..... 347/15, 19, 43, 347/98; 358/504, 406

[56] References Cited

U.S. PATENT DOCUMENTS

| | | | |
|---|---|---|---|
| 5,182,571 | 1/1993 | Creagh et al. | 347/105 |
| 5,547,501 | 8/1996 | Maruyama et al. | 106/31.14 |
| 5,600,350 | 2/1997 | Cobbs et al. | 347/19 |

FOREIGN PATENT DOCUMENTS

| | | | |
|---|---|---|---|
| 0 671 275 | 9/1995 | European Pat. Off. | B41J 2/21 |

*Primary Examiner*—Benjamin R. Fuller
*Assistant Examiner*—Craig A. Hallacher
*Attorney, Agent, or Firm*—Jerry R. Potts

[57] ABSTRACT

Nonoptical properties of inks can be brought to bear in locating ink that is invisible to an automatic sensor. Physical characteristics of inks as liquids can be exploited to reveal their locations with surprising precision. The system includes an optical sensor. Using ink that is visible to the sensor, a preferably fractional fill pattern is printed on a region of a printing medium. Using ink that is invisible to the sensor, calibration indicia or other patterns are printed on particular portions of the same region. Bleed (running together of the liquids of the two inks) tends to convert the fractional fill pattern into a solid fill, within the particular portions that were also printed with the "invisible" ink. Resulting optoelectronic signals provide amply high contrast between (1) fractional fill in the particular portions where the "invisible" ink is applied and (2) the original fractional fill elsewhere. The sensor responds to areas where bleed has converted the fractional fill pattern into a relatively more solid fill. Preferably, to enhance contrast, the visible-ink fractional pattern is printed as aggregations of multiple adjacent pixels, rather than individual, mutually separated pixels—but these aggregations are spaced apart. These two preferences together lead to a pattern that bleeds most effectively of any that were tested. Ideal fill density is roughly twenty-five percent.

19 Claims, 10 Drawing Sheets

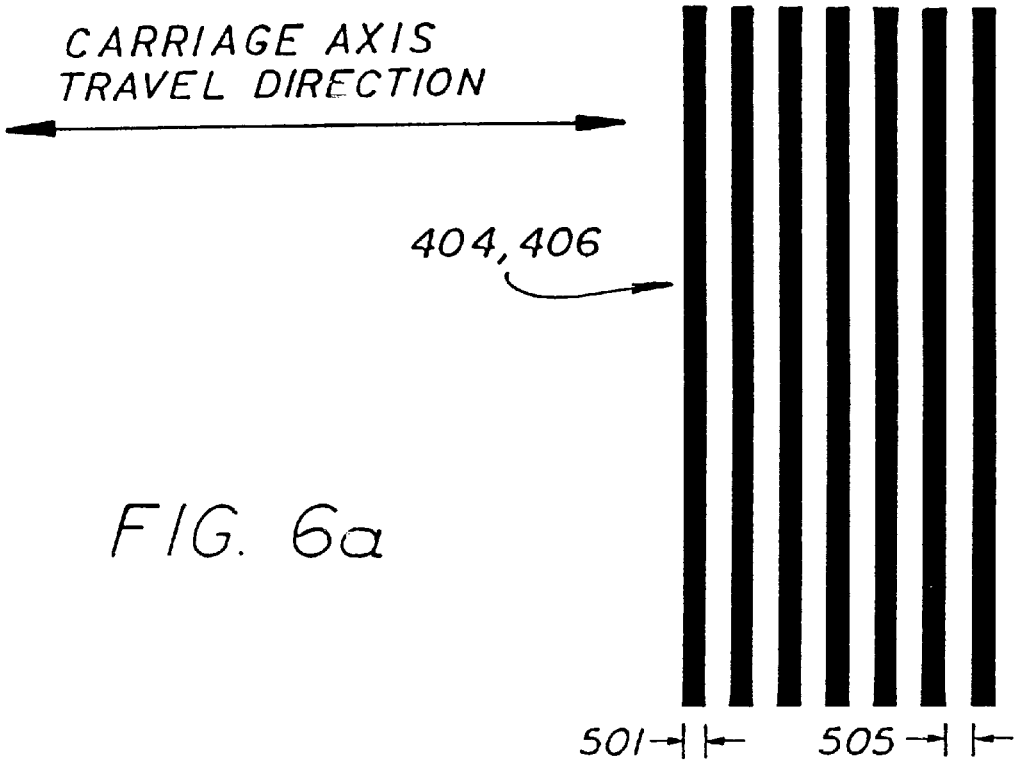
FIG. 6a
FIG. 6b
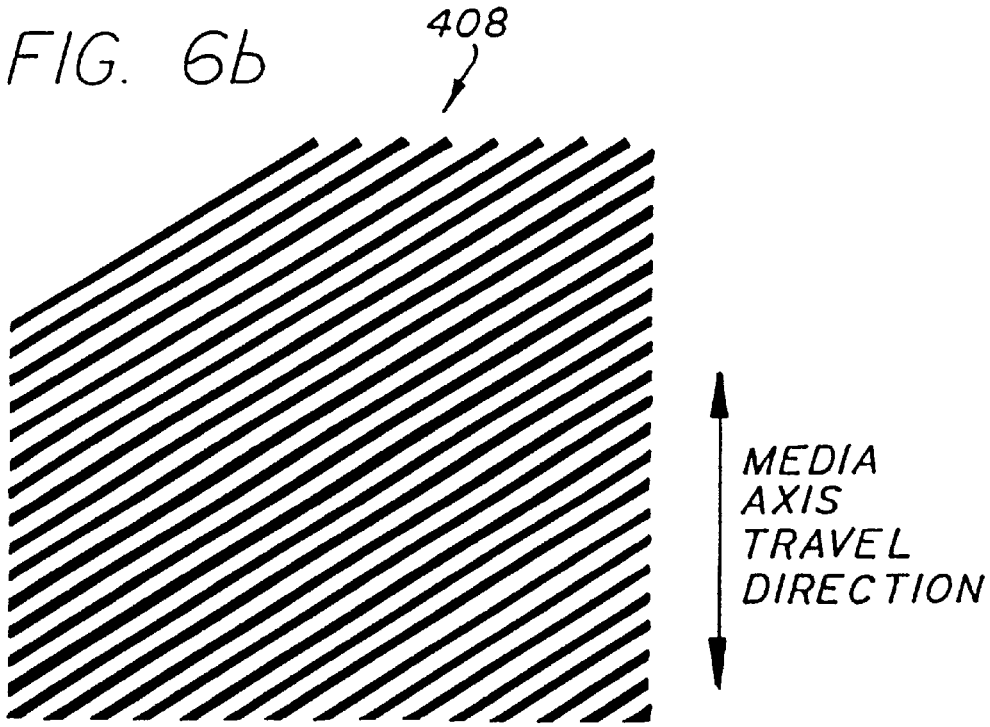

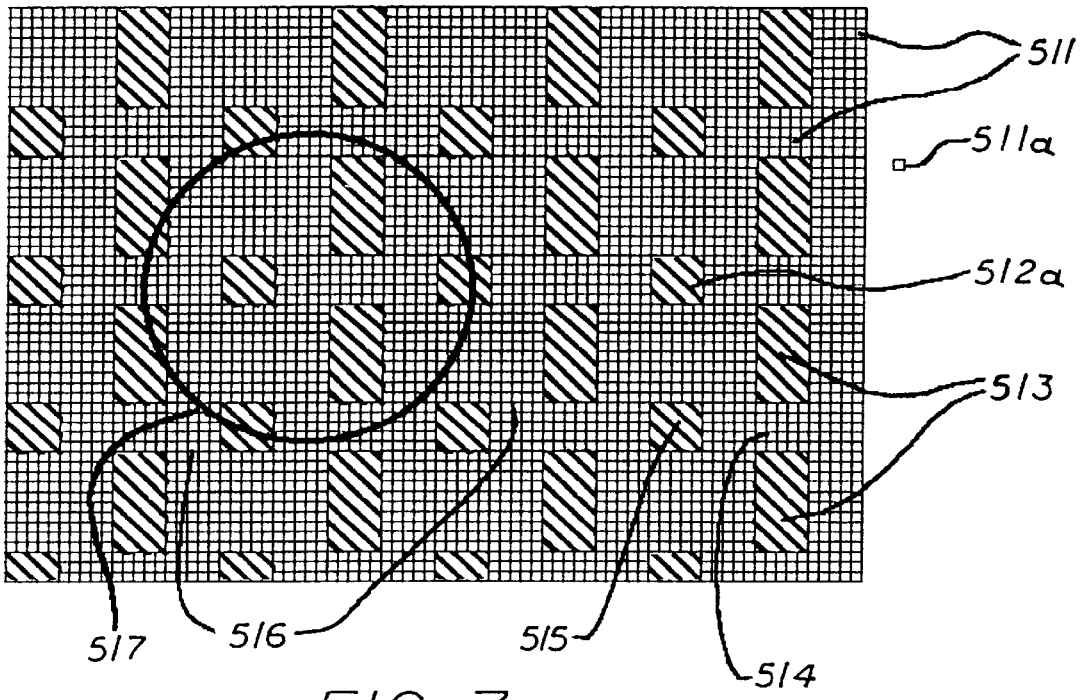
FIG. 7
FIG. 8
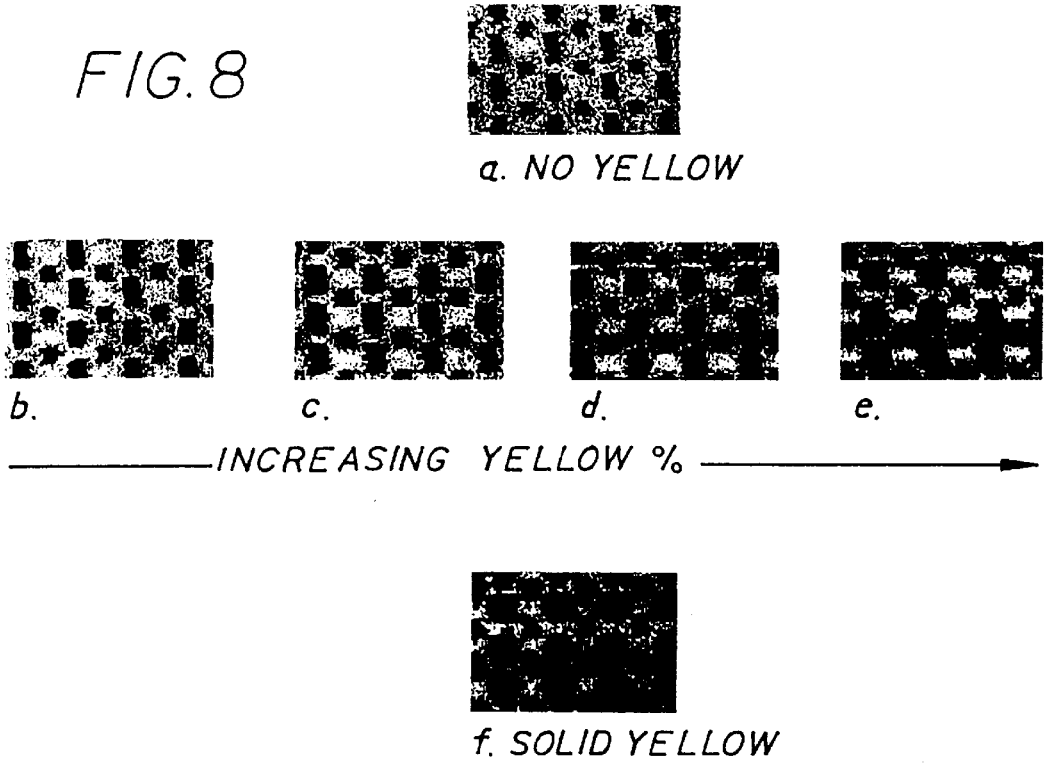

SYSTEMS AND METHOD FOR DETERMINING PRESENCE OF INKS THAT ARE INVISIBLE TO SENSING DEVICES

RELATED PATENT DOCUMENT

Closely related documents are other, coowned U.S. utility-patent applications filed in the United States Patent and Trademark Office before this document—and hereby incorporated by reference in its entirety into this document. Those documents set forth in considerable detail the background of the field of art, problems in the field, and prior efforts to resolve those problems.

Certain of those related documents are in the names of Cobbs et al., and stem from an original patent application entitled "MULTIPLE INKJET PRINT CARTRIDGE ALIGNMENT BY SCANNING A REFERENCE PATTERN AND SAMPLING SAME WITH REFERENCE TO A POSITION ENCODER" and filed as U.S. utility-patent application Ser. No. 08/055,624—abandoned, but succeeded by file-wrapper continuing application Ser. No. 08/540,908, which issued as U.S. Pat. No. 5,600,350 on Feb. 4, 1997, and divisional application Ser. No. 08/585,051, which is abandoned. Another related document is in the names of Sievert et al. and entitled "SYSTEMS AND METHOD FOR ESTABLISHING POSITIONAL ACCURACY IN TWO DIMENSIONS BASED ON A SENSOR SCAN IN ONE DIMENSION". It was filed Mar. 25, 1996, as attorney docket number 10950782D1H50, later assigned Ser. No. 08,625,422 and issued as U.S. Pat. No. 5,796,414 on Aug. 18, 1998.

BACKGROUND

1. Field of the Invention

This invention relates generally to machines and procedures for printing text or graphics in color on printing media such as paper, transparency stock, or other glossy media; and more particularly to a system and method for determining presence and location, on a printing medium, of ink that is of a color invisible to an optical sensor.

Throughout this document, in referring to ink that is invisible to a sensor we implicitly refer to observations of ink coated onto some particular printing medium under some particular illumination. For present purposes—namely, enhancement of calibration-pattern detection for determining positional errors of marking implements such as printheads—the printing medium is ordinarily white paper and the illumination is bright green light from a common and industrially popular light-emitting diode that emits with a peak at 560 nm.

For other purposes, or for other combinations of print medium and illumination—and in particular for other combinations of inks—the specific preferred numerical ranges mentioned in this document will likely require modification even though the fundamental implementation of our invention remains valid.

Furthermore, in referring to color that is invisible to a sensor we mean color that does not itself provide adequate contrast—relative to the printing-medium background without the color—for adequately reliable detection by the sensor. As used here, "contrast" is evaluated within the effective waveband established by the illumination, sensor sensitivity and printing-medium background. As will be seen, our invention artificially elevates such contrast.

The invention is useful particularly but not exclusively in scanning thermal-inkjet printers that construct text or images from individual ink spots created on a printing medium, in a two-dimensional pixel array.

2. Related Art

Automatic sensing of printed image details in a modern computer-controlled desktop printer or drafting-room plotter may be desired for various reasons, such as determining whether a particular printhead or nozzle is laying down ink:

- at a nominal position for that head or nozzle (and, if not, then where); or
- in the nominal inking density or flow volume; or
- at all.

The related patent documents enumerated earlier describe systems and methods for the first of these purposes—i.e., using a sensor system to check the inking position of a printing device.

In addition to these three closely related purposes, automatic sensing is used for:

- registration of image components (most commonly in a multipass plotter) to each other—or to a preprinted registration grid.

All these automatic-sensing applications have become increasingly important commercially with the modern trends toward increased overall automaticity, finer image resolution, and registration tolerances.

In some cases, however, problems may arise when the functions of equipment modules (illuminators and sensors) initially designed into a printer for one use, such as for example merely sensing registration marks printed in black ink, may be expanded to handle some of the other tasks as well. As mentioned above, in a four-color system such other tasks may include, for example, checking ink density for several marking implements that print in various colors respectively.

Systems which evolve in this way may not be well adapted to locating indicia printed in some of the system colors. Spectral emission and sensitivity for light sources and sensors originally selected for economy and efficiency in sensing black indicia may turn out to be blind to some ink colors.

Furthermore, even in a new system, designing around spectral mismatches may become expensive or awkward, since otherwise-ideal narrowband sources or sensors may be inefficient for some spectral regions. Some green or red light-emitting diodes, for example, are popular for their low cost and reliable operation—but magenta ink on white paper may be invisible under red light, and yellow on white paper may be nearly invisible under green light.

Heretofore it has been possible to avoid these mismatches only by resorting to sensors or sources (or both) that are relatively expensive or have other operating drawbacks; or by providing an optical filter and appropriate corresponding source, at additional cost, to create the necessary spectral distinctions.

Thus there remains room for useful and important refinement, in making all colors in a multicolor printing system detectable by commonly used and otherwise desirable sensor/source combinations.

SUMMARY OF THE DISCLOSURE

The present invention introduces such refinement. In its preferred embodiments, the present invention has system and method aspects or facets. They are preferably employed together to optimize the benefits of the invention.

Before setting forth those independent aspects in a formal or relatively rigorous way, we wish to provide an informal introduction to some of the concepts of our invention. It is to be understood that this introduction is not a definition of the invention, although recognition of these concepts may form a part of the inventive process that has led to our invention.

We have recognized that, in optically localizing inks on printing medium, certain properties of inks other than their optical properties can be brought to bear—and this without reliance on chemical effects, though as will be seen certain of the appended claims may encompass use of such effects. More generally, the simple physical characteristics of inks as liquids can be exploited to reveal their locations—and with a surprising degree of precision.

Now we turn to a more-formal description of our invention. In preferred embodiments of a first of its facets or aspects, the invention is a system for determining presence, on a printing medium, of ink that is invisible to an optical sensor.

The system includes an optical sensor. It also includes some means for printing, using an ink that is visible to the sensor, a fractional fill pattern on a region of such printing medium. For generality and breadth, but also for clarity relative to other elements of invention, we will identify these means as the "first printing means".

The system also includes some means for printing, using such ink that is invisible to the sensor, indicia on particular portions of the same region. These means we will call "the second printing means".

For shorthand reference to the ink printed by the second printing means, we use the phrase "invisible ink". Of course it will be understood that ordinarily this ink is quite visible to the normal human eye, even though the sensing system cannot distinguish it well from a white printing-medium background. (Some special applications may make use of ink that is invisible to people as well.)

Bleed, or running together of the liquids, of the two inks tends to convert the fractional fill pattern into a solid fill, within those particular portions. As will be seen from the detailed description that follows, this action is in fact only a tendency—large gaps remain between solidly filled regions.

We prefer, however, to make the sizes of the solid regions, and of the gaps, both small fractions of the area viewed and integrated by the sensor. The resulting optical and electronic signals provide amply high detectable contrast between (1) fractional fill in the particular portions where the "invisible" ink is applied and (2) the original fractional fill in other portions of the region.

The system also includes some means for then locating, or in other words localizing, the particular portions by operating the optical sensor to respond to areas where bleed has converted the fractional fill pattern into a relatively more solid fill.

The foregoing may constitute a description or definition of the first facet of the invention in its broadest or most general form. Even as to this form, however, it can be seen that this aspect of the invention significantly mitigates the difficulties left unresolved in the art.

In particular, the invisible ink has been made visible to the sensor using resources that are already available within the system—without special light sources, sensors or filters.

Although this aspect of the invention in its broad form thus represents a significant advance in the art, it is preferably practiced in conjunction with certain other features or characteristics that further enhance enjoyment of overall benefits.

For example, it is preferred that the first means print the visible-ink fractional pattern in the form of aggregations of multiple adjacent pixels, rather than in the form of individual, mutually separated pixels. This consolidation seems to enhance the liquid overload along the perimeter of the inked area units—and thereby enhance the response to additional liquid when added by the invisible ink.

On the other hand, however, we prefer that the aggregations be spaced apart by spaces—that is to say, uninked (with the visible ink) distances on the printing medium—which also occupy multiple adjacent pixels. Breaking up the aggregations in this way appears to enhance the ratio of perimeter to area so that, again, optimum bleed response is obtained to addition of liquid by the invisible ink.

These two preferences together lead to a pattern that bleeds the most effectively, of the many we have tested. To obtain useful results, also the visible-ink fractional pattern should be printed at a fill density between fifteen and seventy-five percent. An ideal fill density is roughly twenty-five percent.

As suggested by the comments above, the invention works best if the system overprints the invisible ink over the visible ink. To produce this sequence, the second printing means operate after the first printing means operate.

The invention is particularly applicable to enhancing performance of a system that determines positional deviation of a marking implement—particularly an implement which marks in the invisible ink. We therefore prefer to employ the invention in such a system; in this case the second means print a series of positional-calibration indicia in the invisible ink.

In such systems preferably the indicia comprise diagonal lines, as explained in the above-mentioned related patent document of Sievert et al. Also preferably the apparatus includes some means for responding to the locating means to adjust the position of printing with the second means—to compensate for such determined positional deviation.

Other preferences and advantages will be clear from the "DETAILED DESCRIPTION" section that follows.

In a second of its independent aspects or facets, the invention is a method for determining presence, on a printing medium, of ink that is invisible to an optical sensor. The method includes the step of printing, using an ink that is visible to the sensor, a fractional fill pattern on a region of such printing medium.

The method also includes the step of printing, using such ink that is invisible to the sensor, indicia on particular portions of the same region. Bleed of the two inks together tends to convert the fractional fill pattern into a solid fill, within the particular portions.

The method also includes the step of then locating the particular portions by operating the optical sensor to respond to areas where bleed has converted the fractional fill pattern into a relatively more-solid fill.

The foregoing may constitute a description or definition of the second facet of the invention in its broadest or most general form. Even in this general form, however, it can be seen that this aspect of the invention, too, significantly mitigates the difficulties left unresolved in the art. Still, preferences related to those stated above for the system aspect of our invention are applicable to this facet of the invention too.

In a third independent facet or aspect, the invention is a system for determining and using presence of ink that is invisible to an optical sensor. This system includes an optical sensor and a printing medium.

It also includes some means, coated on the printing medium, for interacting with the ink that is invisible to the sensor. These coated means are for interacting with the ink to form indicia that are visible to the sensor.

In addition the system includes means for printing a pattern of calibration ink deposits on the coated means. These printing means operate using the ink that is invisible to the sensor.

Further included in the system are some means for then operating the optical sensor to respond to areas where the coated means and invisible-ink calibration deposits interact to form calibration indicia.

This third aspect of the invention does not necessarily depend upon the statistics inherent in wicking-together of a fractional-fill tone. It therefore may precisely disclose the position of the invisible ink with fewer sensor passes.

All of the foregoing operational principles and advantages of the present invention will be more fully appreciated upon consideration of the following detailed description, with reference to the appended drawings, of which:

BRIEF DESCRIPTION OF THE DRAWINGS

FIG. 6*a* is illustrative of the pure carriage-axis-deviation test-pattern portion (not to scale) of the FIG. 3 test patterns, and is shown even further magnified than in FIG. 3;

FIG. 6*b* is a like view of the "composite information" test-pattern portion of the FIG. 3 embodiment;

FIG. 7 is a simplified diagram of the pixel pattern of inking by the first printing means, for laying down the visible ink (diagonally shaded regions represent inking with the visible ink)—and also shows roughly the relationship between the overall pattern and a portion of it that can be instantaneously monitored by the sensor system; and FIG. 8 is a black-and-white resolution of a photomicrograph showing an actual printed pattern of visible ink, with no overprinted invisible ink; and also showing the bleed response of the visible ink to the overprinted invisible ink, for five densities of the invisible ink.

DETAILED DESCRIPTION OF THE PREFERRED EMBODIMENTS

Figure 1:
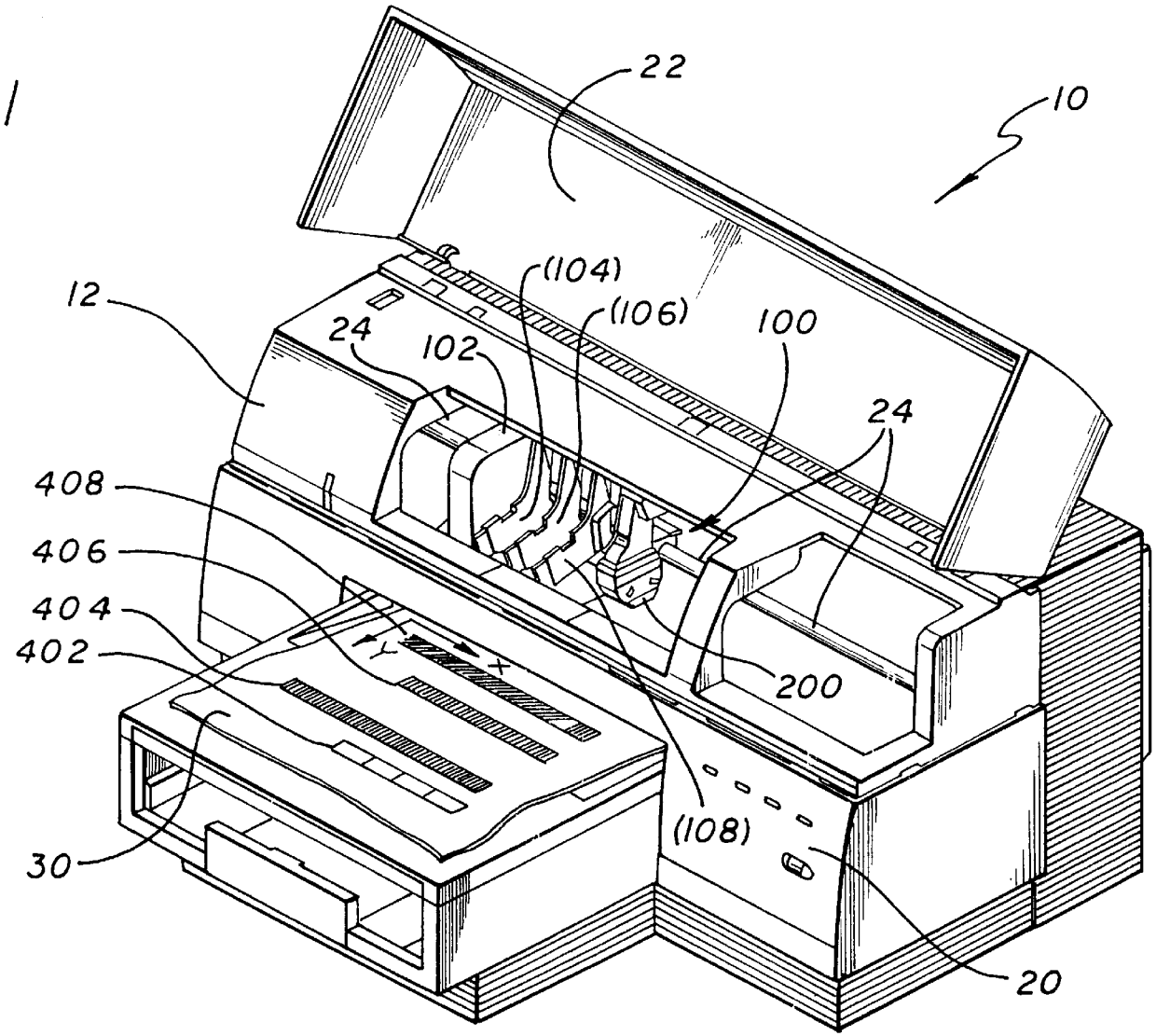
FIG. 1 is a perspective view of a thermal inkjet desktop printer incorporating or constituting (not to scale) a preferred embodiment of the present invention.
Figure 1A:
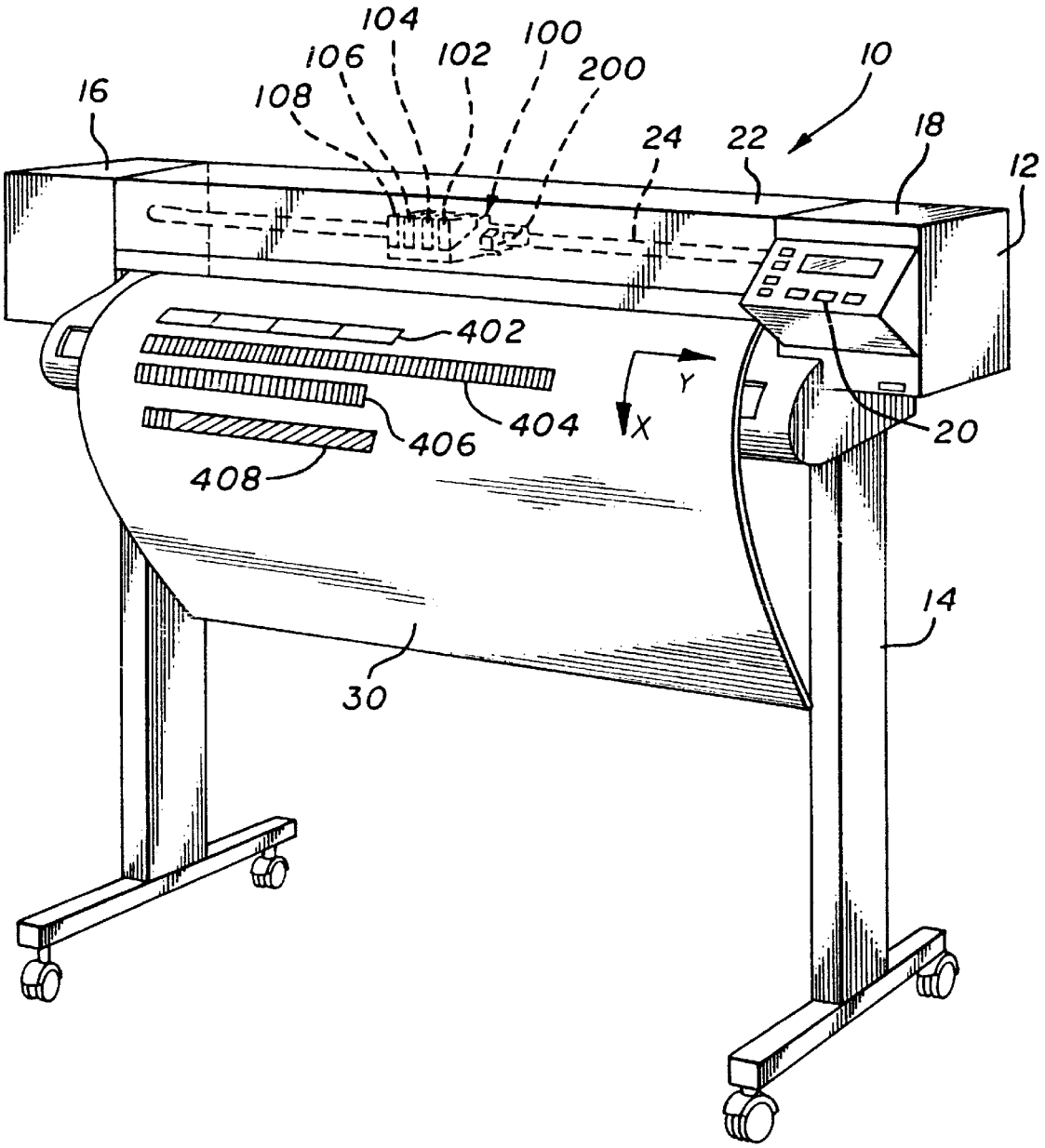
FIG. 1*a* is a like view of a large-format printer/plotter likewise incorporating or constituting the FIG. 1 embodiment of the present invention—corresponding components having like reference numerals, respectively.

As FIGS. 1 and 1*a* indicate, preferred embodiments of the invention are advantageously incorporated into an automatic printer, as for instance a thermal-inkjet desktop printer or large-format plotter respectively. The printer or plotter 10 includes a housing 12, with a control panel 20.

As to the plotter of FIG. 1*a*, the working parts may be mounted on a stand 14; and the housing 12 has left and right drive-mechanism enclosures 16 and 18. The control panel 20 is mounted on the right enclosure 18.

A carriage assembly 100 (which for the large-format plotter of FIG. 1*a* is illustrated in phantom under a transparent cover 22), is adapted for reciprocal motion along a slider rod or carriage bar 24 (also in phantom for the plotter). The position of the carriage assembly 100 in a horizontal or carriage-scan axis is determined by a carriage positioning mechanism (not shown) with respect to an encoder strip (not shown), as is very well known in the art.

Preferably the carriage 100 includes four stalls or bays for automatic marking implements such as inkjet pens that print with ink of different colors. These are for example black ink and three chromatic-primary (e.g. yellow, magenta and cyan) inks, respectively.

FIG. 1 shows, for the desktop printer, a single representative pen 102—and the remaining three empty bays marked with reference numbers in parentheses thus: (104), (106) and (108). For the large-format plotter, FIG. 1*a* shows all four pens 102, 104, 106, and 108.

In both the printer and the plotter, as the carriage assembly 100 translates relative to the medium 30 along the x and y axes, selected nozzles in all four thermal-inkjet cartridge pens are activated. In this way ink is applied to the medium 30.

The colors from the three chromatic-color inkjet pens are typically used in subtractive combinations by overprinting to obtain secondary colors; and in additive combinations by adjacent printing to obtain other colors.

Figure 2:
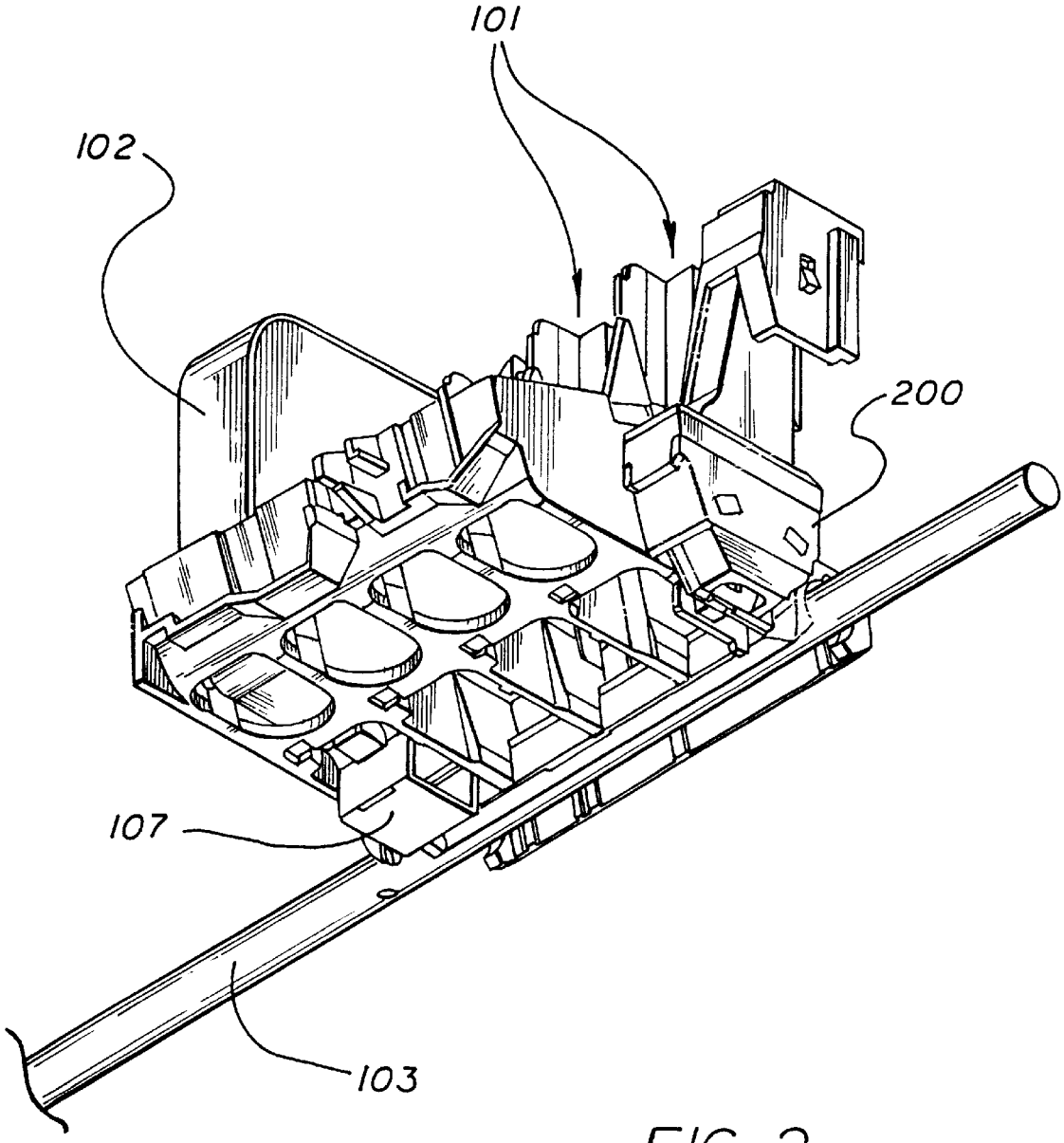
FIG. 2 is a perspective view, taken from below and to the right, of the carriage assembly of the FIG. 1 (desktop printer) embodiment, showing the sensor module generally.
Figure 2A:
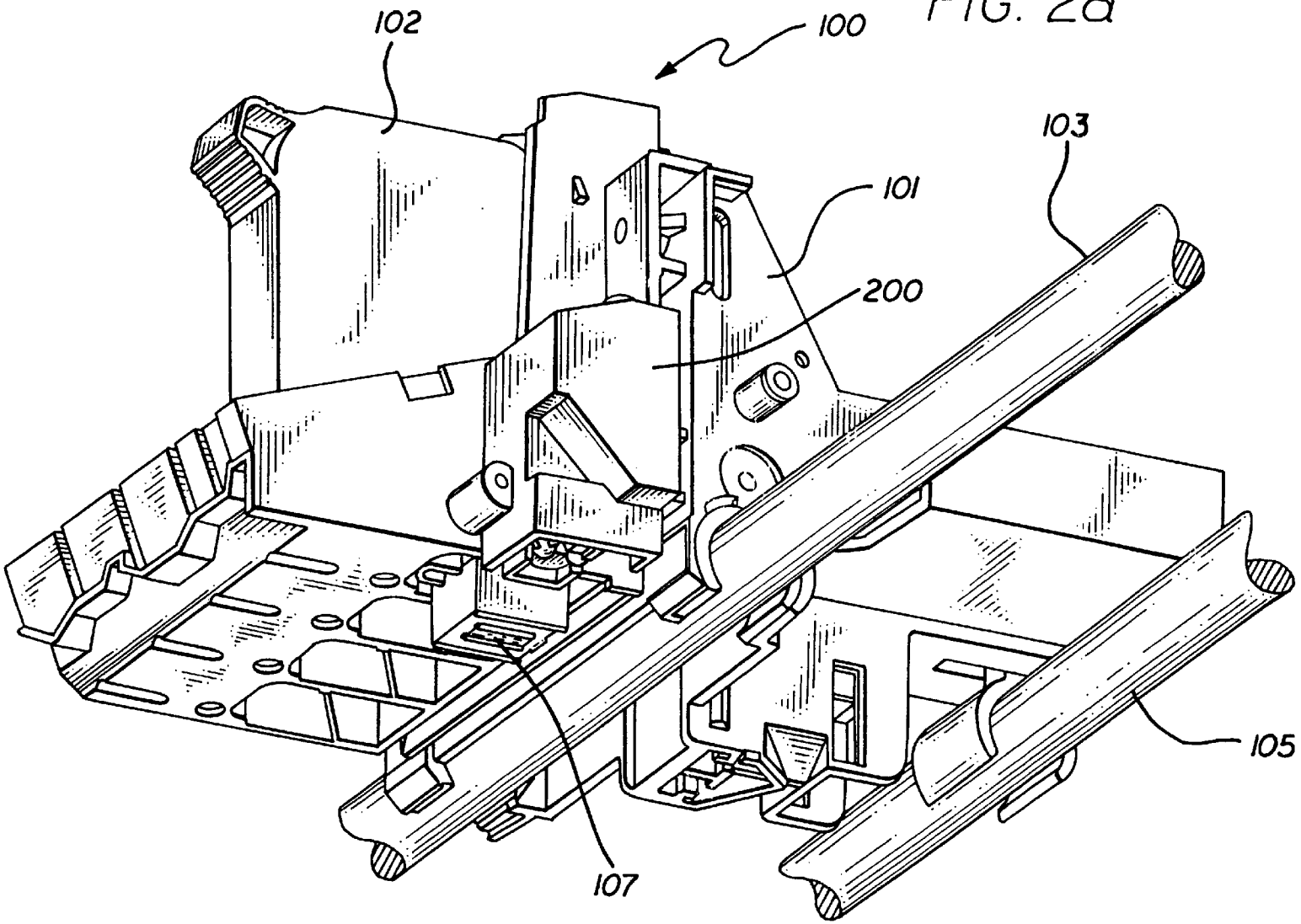
FIG. 2*a* is a like view of the corresponding carriage assembly of the FIG. 1*a* (large-format plotter) embodiment.

The carriage assembly 100 includes a carriage 101 (FIG. 2) adapted for reciprocal motion on a slider bar or carriage rod 103. For the much greater transverse span in the large-format plotter (FIG. 2*a*), there are a front slider rod or carriage bar 103 and a like rear rod/bar 105. A representative first pen cartridge 102 is shown mounted in a first stall of the carriage 101.

Considerable additional information about a carriage drive and control system that is suitable for integration with the present invention appears in the Cobbs et al. documents. That drive and control system is substantially conventional and will not be further treated here.

A printing medium 30 such as paper is positioned along a vertical or printing-medium-advance axis by a medium-advance drive mechanism (not shown). As is common in the art and as mentioned earlier, for desktop printers the carriage-scan axis is denoted the x axis and the medium-advance axis is denoted the y axis; and for large-format plotters conversely.

Printing-medium and carriage position data go to a processor on a circuit board that is preferably on the carriage assembly 100, for the large plotter, or elsewhere in the chassis for the desktop model. The carriage assembly 100 also may hold circuitry required for interface to firing circuits (including firing resistors) in the pens.

Also mounted to the carriage assembly 100 is a sensor module 200. Note that the inkjet nozzles 107 (FIG. 2) of the representative pen 102, and indeed of each pen, are in line with the sensor module 200.

Full-color printing and plotting require that the colors from the individual pens be precisely applied to the printing medium. This requires precise alignment of the carriage assembly. Unfortunately, paper slippage, paper skew, and mechanical misalignment of the pens in conventional inkjet printer/plotters result in offsets along both the medium- or paper-advance axis and the scan or carriage axis.

Preferably a group of test patterns 402, 404, 406, 408 is generated (by activation of selected nozzles in selected pens while the carriage scans across the medium) whenever any of the cartridges is disturbed—for instance just after a marking implement (e.g., pen) has been replaced. The test patterns are then read by scanning the electrooptical sensor 200 over them, and analyzing the resulting waveforms.

The sensor module 200 optically senses the test pattern and provides electrical signals to the system processor, indicative of the registration of the portions of the pattern produced by the different marking implements respectively.

Figure 5:
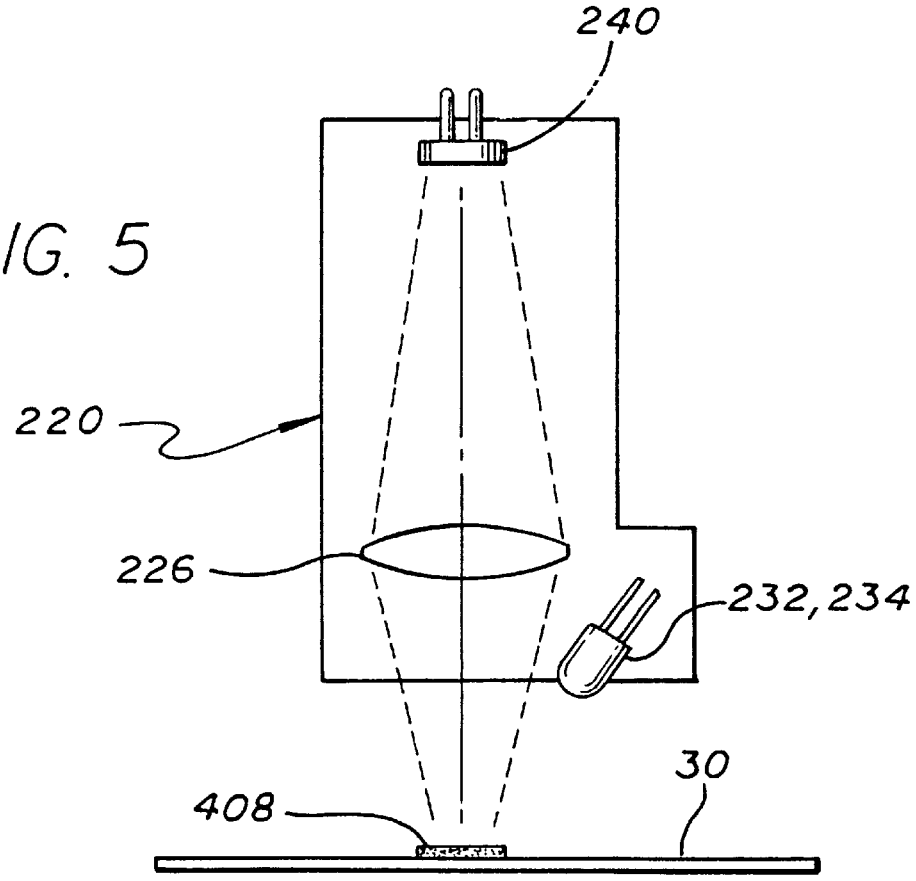
FIG. 5 is a very highly schematic diagram of the optical elements in the sensor module of the preferred desktop-printer embodiment of FIGS. 1, 2, and 4*a* through 4*c*.

FIGS. 4*a* through 4*d* show representative sensor modules 200 utilized in the two preferred embodiments of the lower-numbered drawings. Each sensor module 200 includes an optical component holder 222, with a lens 226 (or if preferred a more-complicated focal system with a second lens 228, FIG. 4*d*, such as that shown by Cobbs et al.) fixed relative to a detector 240 (FIG. 5).

First and second light-emitting diodes (LEDs) 232 and 234 are mounted to the sensor module 200, at an angle as shown, along with an amplifier and other circuit elements (not shown). The light-emitting diodes and photodetector are of conventional design, and they form a sensing system which can discriminate very well between the presence and the absence of ink, for three of the four marking implements 102, 104, 106, 108—namely for the colors cyan, magenta and black.

For the fourth of these implements, however, this discrimination process fails to be adequate. The spectral bandwidth of commonly available, economical LEDs is relatively narrow, and it is spectrally positioned entirely within the high-reflectance spectral range of the ink that is used in the yellow-ink marking implement.

Within that narrow spectral emission band of the LEDs, the reflectance of this yellow ink, coated on white paper, is only a few percent less than the reflectance of the paper alone. The sensing system is therefore unable to distinguish cleanly between the corresponding yellow light and the white background of a typical printing medium 30.

For best results, therefore, special measures in accordance with the present invention are employed to obtain fully adequate data with respect to a yellow-ink marking implement.

While this ambiguity may be resolved by use of an optical filter, or by special sources or detectors, we prefer to avoid the associated added cost by printing a percentage-tone background using magenta ink, and then immediately overprinting the yellow test-pattern bars. The yellow ink mixes and interacts with the still-damp magenta ink.

These processes cause spreading and wicking that tend to convert the percentage magenta tone to solid orange inking, in and near the regions where the yellow "bars" are printed. The result is more-nearly solid (and expanded) orange bars, which the sensor readily detects.

As will be understood, while these solid color bars appear orange to the human eye, to the sensing system (with its narrow bandwidth imposed by the LEDs) the presence of the yellow ink is spectrally immaterial, and the color bars are therefore indistinguishable from solid (and expanded) magenta.

As FIG. 7 shows, the visible (e.g., magenta) ink is not laid down in individual isolated pixels 511 (a single pixel is shown separately at 511*a* to more clearly convey its size), but rather in aggregations or so-called "superpixels" 512, 515 which are typically five pixels square. Some of the aggregations 513 amount to two superpixels, being five pixels wide and ten pixels tall.

As explained earlier, this inking by aggregation 512, 513, 515 has been found preferable for enhancing contrast between areas where invisible ink is later applied and areas where it is not. On the other hand, the aggregations 512, 513, 515 are not entirely continuous over the entire image but rather are broken up.

More specifically, the columns of double-superpixel aggregations 513 are separated by uninked spaces 514 equal in area to one superpixel. As also explained previously, this ample separation, too, between pixel aggregations has been found preferable in optimizing contrast.

Ink that might have gone into these superpixel-sized spaces or separations 514 is instead displaced laterally to form columns of single superpixels 512, 515 which are halfway between the columns of double superpixels 513. The spaces 516 between columns of single and double superpixels are also five pixels wide.

By visualizing the single superpixels 512, 515 as moved over into the spaces 514 within columns of double superpixels 513, it can be easily verified visually that the overall pattern of FIG. 7 is inked in one five-pixel-wide column out of every twenty-pixel-wide region. Thus the density of this illustrated pattern is twenty-five percent The circle 517 drawn superimposed on the pixel and superpixel pattern represents very approximately the area which can be within the field of view of the system sensor at any moment. In FIG. 7 the circle 517 happens to have been placed in a position where shaded pixels are roughly twenty-one percent of the total; however, this is merely an accident of illustration.

In other placements on the same inking pattern, a circle this size can contain even fewer than twenty percent, or more than thirty percent, shaded pixels. On average the number is of course twenty-five percent.

Now if progressively greater densities of the invisible ink are overprinted promptly (to minimize drying) after laying down this special undergrid, the resulting bleed patterns, too, have a corresponding progressively greater density. The actual patterns, very greatly enlarged relative to an actual twelve- or thirteen-pixel-per-millimeter print sample—but only about one-sixth the scale used in FIG. 7—are as shown in FIG. 8.

The FIG. 7 pattern is clearly visible in the micrographs of FIG. 8, particularly in view a, where the density of yellow was zero. In the six views of FIG. 8 the variations in gray-background tone should be disregarded, as they are primarily an artifact of the reproduction process used to prepare the illustration.

The features of interest, which appear with reasonable accuracy, are the progressive irregular enlargement, and progressive running together, of the visible-ink superpixel forms. In the monochrome presentation of FIG. 8, the initial magenta superpixels of view a are indistinguishable in color from the expanded and wicked-together ragged orange superpixels of views b through f. This gray-scale presentation is quite appropriate, as it corresponds in substance to what a sensor can detect under the narrowband green illumination from the LEDs.

In the successive views the successively greater wicking, irregularity and enlargement are plainly monotonic with invisible-ink density. On the other hand a careful examination of these views also suggests, correctly, that the reflectances resulting from these phenomena—based on interactions between fluids of the ink and fibers or pores of the printing medium—are subject to a great deal of random variation. This variation is superimposed upon the previously-mentioned variation due to placement of the sensitive area (517, FIG. 7) on the superpixel pattern.

We have found it fully satisfactory to resolve this variability through simple numerical analysis based on well-known sampling theory. Any simple signal-averaging technique, in the presence of noise that is random or essentially random, reduces the effects of the noise in proportion to the square root of the number of signal samples.

Accordingly the technique which we have developed works best with plural or multiple passes of the sensor over, for example, a pattern of positional-calibration bars. Data are stored in the several runs, and the stored data averaged to extract the actual position of the bars printed in "invisible" (e.g., yellow) ink—and from this information the desired pen-position offsets or the like.

In our present application of this invention, the only discrimination of interest is between no yellow (view a, FIG. 8) and solid yellow (view f). It will be apparent from the intermediate views, however, that with careful interpretation and control techniques the invention can be used to develop intermediate discriminations, if desired for other applications.

In operation, light from the LEDs 232 and 234 (FIGS. 4*c* and 5) impinges upon the test patterns 408 etc. on the printing medium 30 and is in part reflected to the photodetector 240 via the focal system 226—which focuses the energy onto the photodetector 240. As the sensor module 200 scans the test pattern 406 or 408 along the carriage-scan axis only, an output signal is provided which varies approximately as a sine wave.

Associated circuitry (shown and discussed in the companion Sievert et al. patent document) stores these signals, averages them as mentioned above, and examines their phase relationships to determine the alignments of the pens for each direction of movement. Fourier-transform methods, of either the "fast" or "discrete" type, advantageously facilitate this process.

More specifically, the Fourier transform of the data is determined and the phase then extracted from the transform by comparison of its real and imaginary parts (i.e., sine and cosine components). We prefer to program the system to find just a single term of the discrete Fourier transform, corresponding to the fundamental; the arctangent of the ratio of imaginary and real parts for this term then reveals the phase for the calibration process.

Preferably the system corrects for carriage-axis misalignment—and print-medium-axis misalignment—and can be used to correct for offsets due to speed and curvature as well. Further details of these options are discussed at length in the Cobbs et al. documents and so need not be repeated here.

The Cobbs and Sievert documents further describe, in detail, correction for deviations in the carriage-scan axis, and also correction of offsets in the printing-medium-advance axis and between pens.

Figure 3:
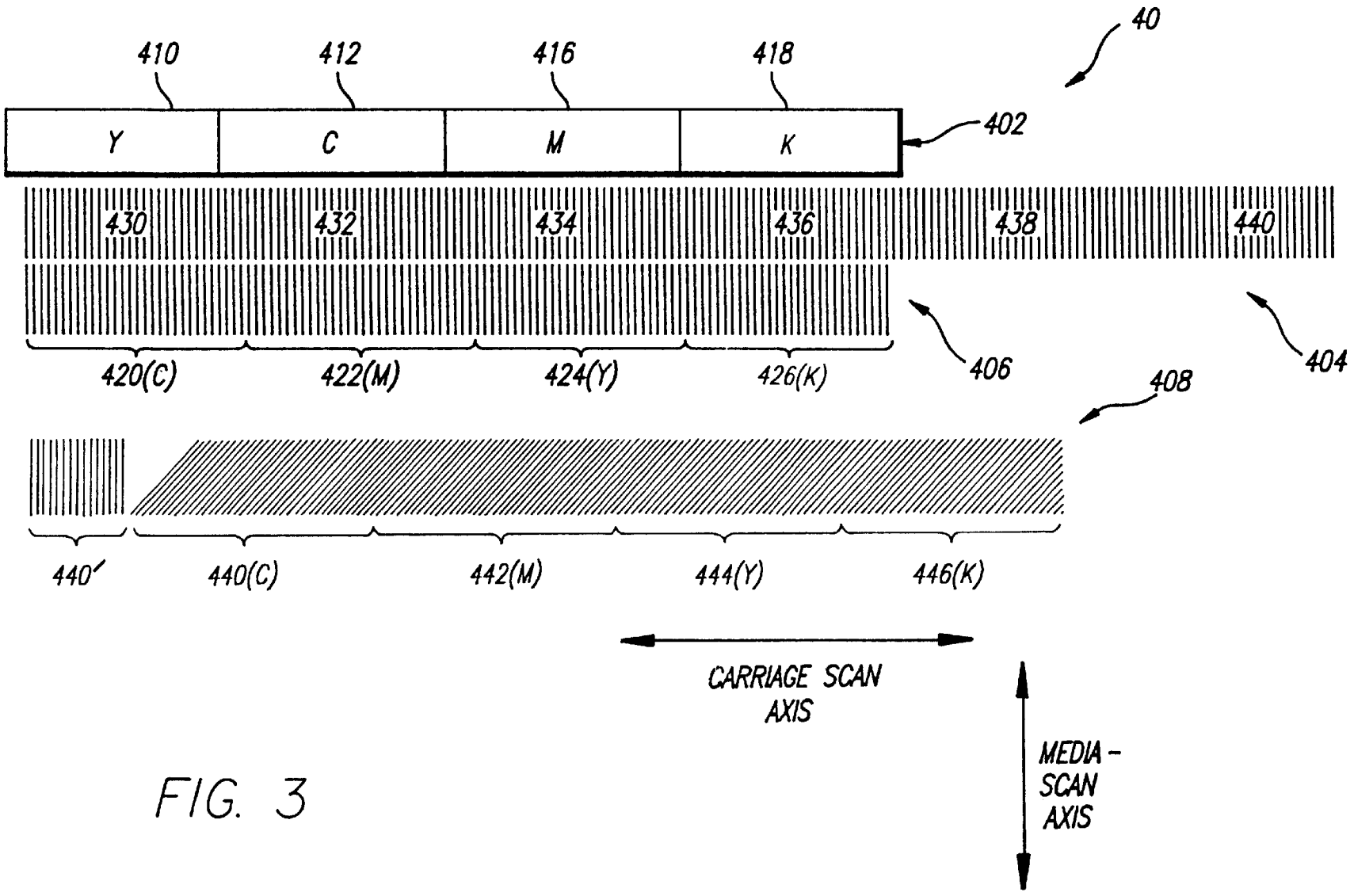
FIG. 3 is a magnified view (not to scale) of test patterns utilized to effect pen alignment in accordance with the same two embodiments.
Figure 4A:
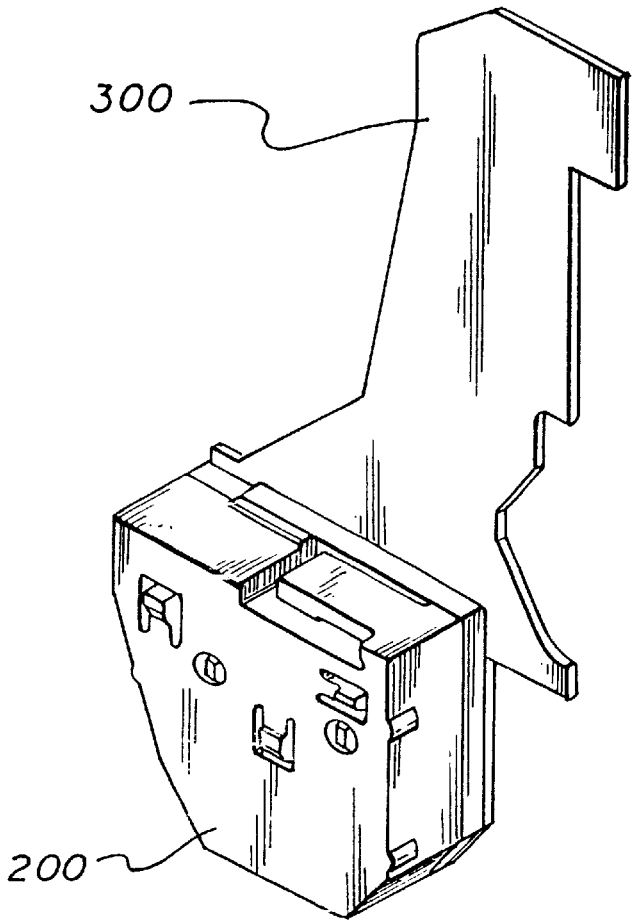
FIG. 4*a* is an exterior perspective view of the sensor module and associated printed-circuit board used in the preferred embodiment of FIGS. 1 and 2.
Figure 4B:
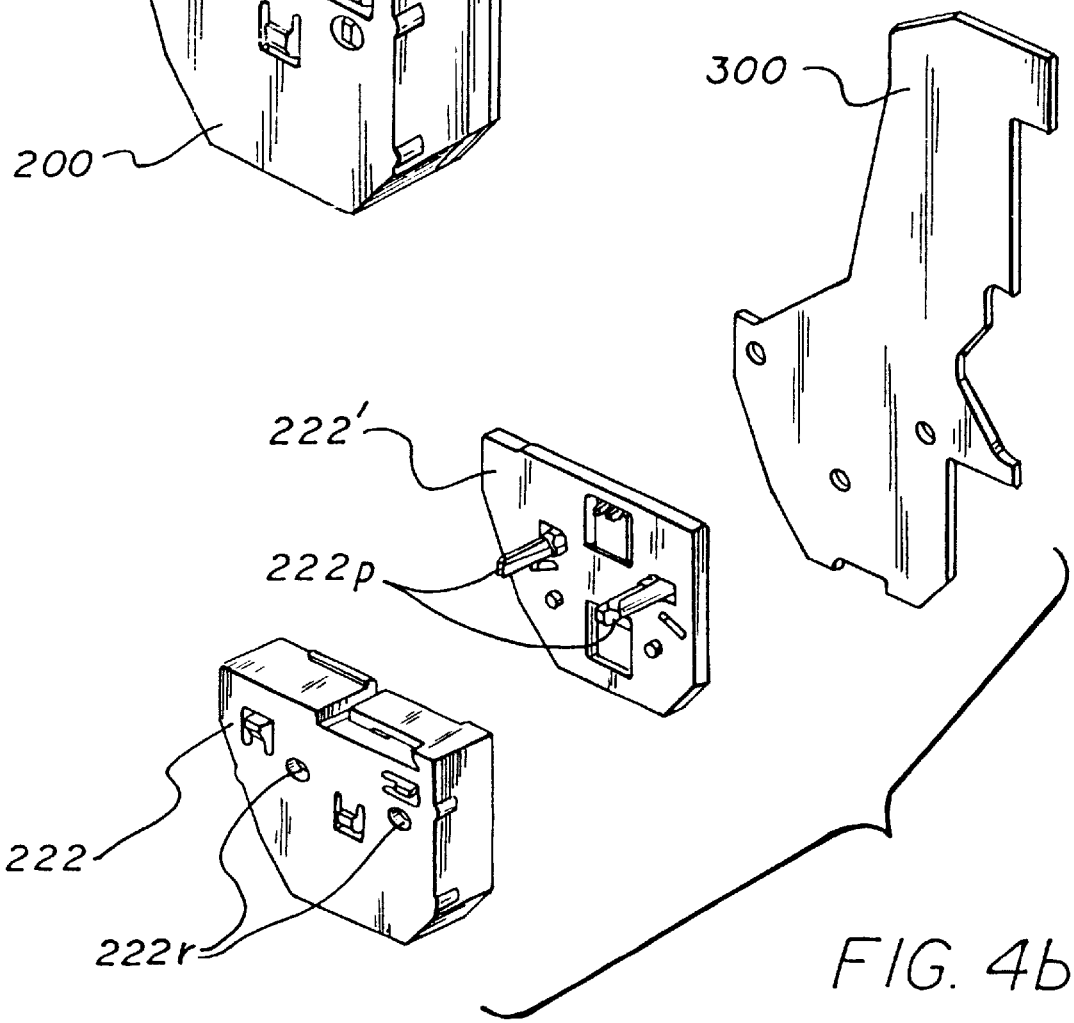
FIG. 4*b* is an exploded perspective view of the two half-cases of the FIG. 4*a* sensor module and printed-circuit board.
Figure 4C:
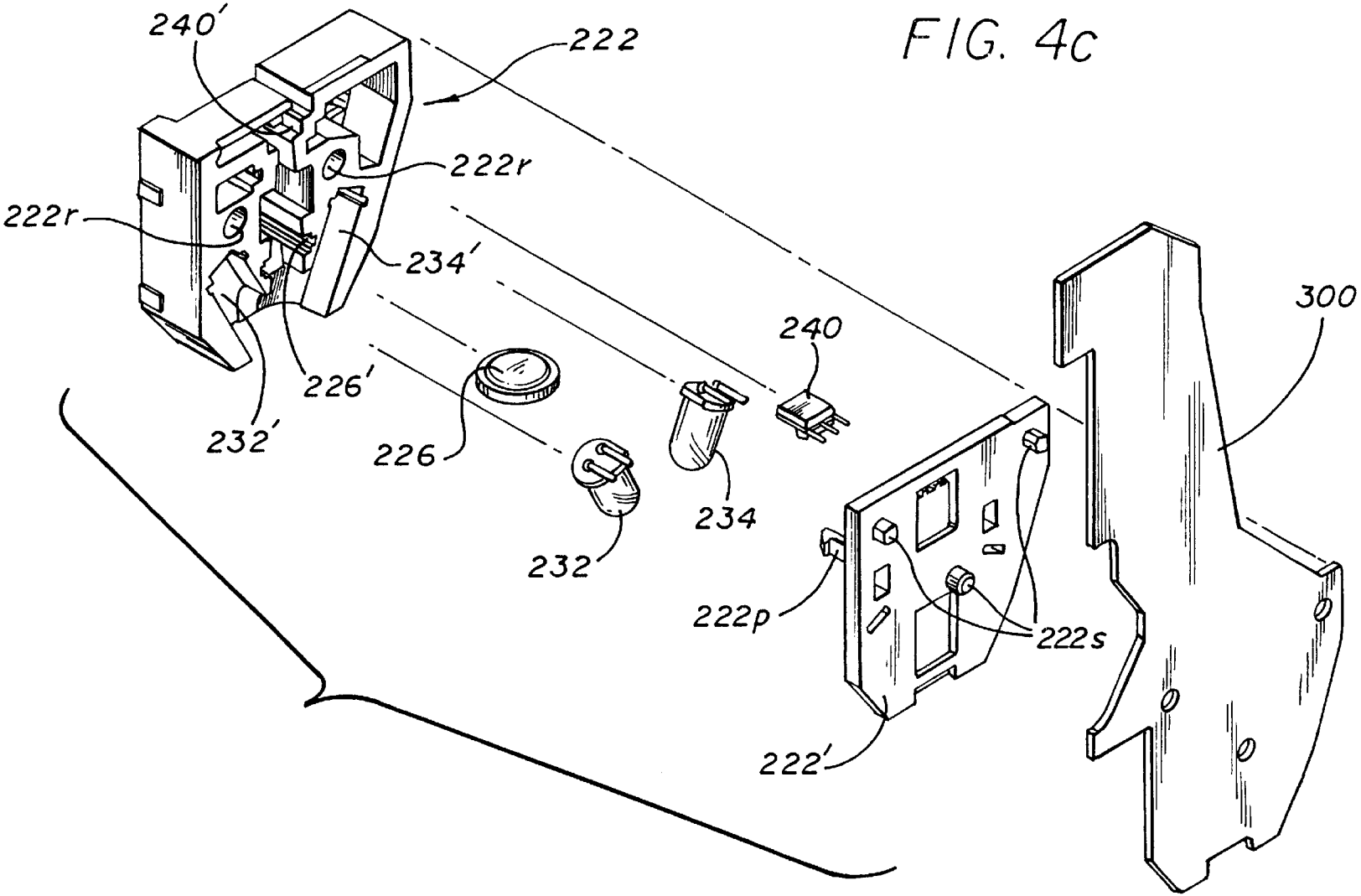
FIG. 4*c* is an exploded perspective view of the same elements shown in FIG. 4*b* but taken from the opposite side and also including the interior components.
Figure 4D:
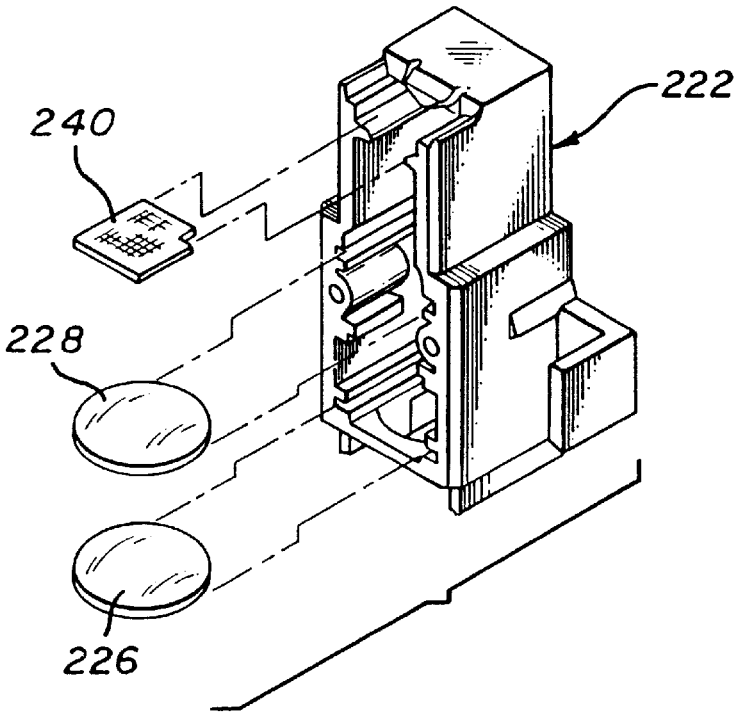
FIG. 4*d* is an interior perspective view of a principal inner subassembly of a sensor that may be used in the preferred embodiment of FIGS. 1*a* and 2*a*.

To use the yellow-over-magenta printing system according to the present invention, it is helpful to print the yellow and magenta inks in very close time sequence. This can be accomplished most effectively during scanning from right to left, if the pens are physically disposed in the sequence of FIG. 3.

Offsets between pens, along the medium-advance axis, can be corrected by selecting certain nozzles for activation, as described by Cobbs et al., or by masking the data as between swaths of the marking implements as mentioned by Sievert et al. The Cobbs technique has the drawback of requiring extra nozzles; whereas the Sievert technique has the drawback of introducing undesirable variations in colorant-laydown sequence in some regions of the printout, and also somewhat increasing computation complexity and time.

In certain of the appended claims the word "such" has been used instead of "the" or "said," to more particularly and distinctly point out elements of the context or environment of the invention, first recited in preamble—as distinguished from elements of the invention itself.

The foregoing detailed disclosure is intended as merely exemplary, and not to limit the scope of the invention—which scope is to be determined by reference to the appended claims.

What is claimed is:

1. A system for determining presence of invisible ink in plural inks of respective colors printed on a printing medium; said system comprising:

an optical sensor to which at least one of the plural inks is invisible and at least another one of the plural inks is visible;

means for exposing a region of the printing medium to the optical sensor while the sensor is operated, first means for printing, using one of the plural inks that is visible to the sensor, a fractional fill pattern on the region;

second means for printing, using another one of the plural inks that is invisible to the sensor, indicia on particular portions of said region;

whereby bleed of the visible ink and the invisible ink together tends to covert said fractional fill pattern into a fill pattern that is more solid than said fractional fill pattern, within said particular portions; and means for then locating the particular portions by operating the optical sensor to scan said sensor-accessible region and respond to areas where bleed has converted said fractional fill pattern into a fill pattern that is more solid than said fractional fill pattern.

2. The system of claim 1, wherein:

the first means comprise means for printing the visible-ink fractional pattern as aggregations of multiple adjacent pixels.

3. The system of claim 2, wherein:

the aggregations are spaced apart by spaces which also are aggregations of multiple adjacent pixels.

4. The system of claim 1, wherein:

the first means comprise means for printing the visible-ink fractional pattern at a fill density between fifteen and seventy-five percent.

5. The system of claim 4, wherein:

the fill density is roughly twenty-five percent.

6. The system of claim 1, wherein:

to overprint the invisible ink over the visible ink, the second printing means operate after the first printing means operate.

7. The system of claim 1, for use in positional calibration of a marking implement which marks in the invisible ink; and wherein;

the second means comprise means for printing at a printing position a series of positional-calibration indicia in the invisible ink; and the locating means provide such positional calibration by responding to said indicia printed in the invisible ink.

8. The system of claim 7, wherein:

the indicia comprise diagonal lines.

9. The system of claim 7, further comprising:

means for responding to the locating means to adjust the position of printing with said second means, to apply positional calibration.

10. The system of claim 1, wherein:

the ink that is visible to the sensor is magenta ink;

the ink that is invisible to the sensor is yellow ink; and the sensor is a semiconductor detector.

11. The system of claim 10, further comprising:

for illuminating both inks on such printing medium, a light source which emits primarily in a green portion of the visible spectrum.

12. A method for determining presence of invisible ink on a printing medium printed in plural inks of respective colors comprising:

printing a fractional fill pattern on a region of the printing medium using one of the plural inks that is visible to an optical sensor;

printing, using another one of the plural inks that is invisible to the sensor, indicia on particular portions of said region;

whereby bleed of the visible ink and the invisible ink together tends to convert said fractional fill pattern into a fill pattern that is more solid than said fractional fill, within said particular portions; and locating said particular portions by operating the optical sensor to respond to areas where bleed has converted said fractional fill pattern into a fill pattern that is more solid than said fractional fill.

13. The method of claim 12, wherein:

the visible-ink printing step comprises printing the visible-ink fractional pattern as aggregations of multiple adjacent pixels.

14. The method of claim 12, wherein:

the visible-ink printing step comprises printing the visible-ink fractional pattern at a fill density between about fifteen and seventy-five percent.

15. The method of claim 14, wherein:

the visible-ink fractional-pattern printing step comprises printing a fill density of roughly twenty-five percent.

16. The method of claim 12, for use in positional calibration of a marking implement which marks in the invisible ink; and wherein:

the second printing step comprises printing at a printing position a series of positional-calibration indicia in the invisible ink; and the locating step provides the positional calibration by responding to said indicia printed in the invisible ink.

17. The method of claim 16, wherein:

the positional-calibration indicia-printing step comprises printing the indicia as diagonal lines.

18. The method of claim 16, further comprising the step of:

responding to the locating step to adjust the position of printing with said invisible ink, to apply the positional calibration.

19. The method of claim 12, further comprising the steps of:

recording instructions for the responding step, the visible-ink printing step, the invisible-ink printing step, and the locating step in a memory device; and automatically retrieving and effectuating said instructions from the memory device to effect performance of the responding step, the visible-ink printing step, the invisible-ink printing step, and the locating step.

* * * * *